US005531214A

United States Patent [19]

Cheek

[11] Patent Number: 5,531,214

[45] Date of Patent: Jul. 2, 1996

[54] GAS VENT AND BURNER MONITORING SYSTEM

[76] Inventor: Ricky L. Cheek, 1944 Bernhurst Dr., Knoxville, Tenn. 37918

[21] Appl. No.: 449,010

[22] Filed: Apr. 24, 1995

[51] Int. Cl.[6] ..... F24N 1/00

[52] U.S. Cl. ..... 126/361; 431/14; 431/16; 431/22; 431/76; 122/17

[58] Field of Search ..... 431/14, 16, 19, 431/21, 22, 76; 126/361; 122/13.1, 14, 16, 17

[56] References Cited

U.S. PATENT DOCUMENTS

| | | | |
|---|---|---|---|
| 3,123,027 | 3/1964 | Livingston | 431/19 |
| 3,162,846 | 12/1964 | Giudice | 431/76 |
| 3,447,746 | 6/1969 | Visos | 236/21 |
| 3,948,439 | 4/1976 | Heeger | 236/21 B |
| 3,973,898 | 8/1976 | Seider | 431/76 |
| 4,262,843 | 4/1981 | Omori et al. | 236/15 C |
| 4,315,730 | 2/1982 | Watson | 431/76 |
| 4,583,937 | 4/1986 | Yamana | 431/76 |
| 5,056,712 | 10/1991 | Enck | 236/20 R |
| 5,092,519 | 3/1992 | Staats | 236/21 B |
| 5,158,446 | 10/1992 | Hall | 431/20 |
| 5,186,386 | 2/1993 | Lynch | 431/19 |
| 5,197,665 | 3/1993 | Jenson et al. | 236/26 |
| 5,280,802 | 1/1994 | Comuzie | 431/16 |

*Primary Examiner*—Carroll B. Dority
*Attorney, Agent, or Firm*—Pitts & Brittian

[57] ABSTRACT

A gas vent and burner monitoring system for monitoring a gas burner vent appliance. The system includes an alarm, a first sensor proximate the burner and a second sensor proximate the draft hood. Each sensor detects the occurrence of an event and the respective sensor activates the alarm when the event occurs.

14 Claims, 2 Drawing Sheets

GAS VENT AND BURNER MONITORING SYSTEM

TECHNICAL FIELD

This invention relates to the field of control systems for gas burner vent appliances such as a water heater, boiler, furnace or the like.

BACKGROUND ART

A gas burner vent appliance generally includes a combustion chamber, a vent hood including a flue and an outlet pipe. In a forced draft appliance, a fan having an inlet connected to the vent hood and an outlet connected to the outlet pipe and an interior pressurized housing is also included. The flue communicates with the combustion chamber and provides an outlet for the exhaust of combustion gases and excess heat of combustion. In a forced draft appliance, the fan draws in ambient air to mix with the combustion gases passing through the flue to lower the combustion gas temperature. The mixture is subsequently drawn through the fan and vented through the outlet pipe.

It is common practice to include a monitor and control system for the appliance to monitor and/or control various aspects of the operation of the appliance. Typical of the art are those devices disclosed in the following U.S. patents:

| Pat. No. | Inventor(s) | Issue Date |
|---|---|---|
| 3,447,746 | C.D. Visos | June 3, 1969 |
| 3,948,439 | R.B. Heeger | April 6, 1976 |
| 4,262,843 | Omori et al. | April 21, 1981 |
| 5,056,712 | H.J. Enck | Oct. 15, 1991 |
| 5,092,519 | C.W. Staats | March 3, 1992 |
| 5,158,446 | J.H. Hall | Oct. 27, 1992 |

The '746 patent teaches a fuel flow control device which includes a temperature response valve for controlling gas flow to the burner to maintain a preselected water temperature.

The '439 patent teaches a sediment buildup warning device for water heaters which senses a predetermined increase in temperature above the normal operating temperature in the lower portion of the tank as the result of buildup of lime or other sediment in the bottom of the tank.

The '843 patent teaches a method and apparatus for controlling the feed amount of air for combustion in a natural draft type heating furnace. The feed amount of air for combustion is controlled based upon various measured values. The device does not detect and respond to emergency situations.

The '712 patent teaches a water heater controller including a plurality of temperature sensors which provide temperature data inputs to the processor and control unit. The controller relies on temperature measurements to control the water heater operation as a function of actual hot water usage. The controller is not designed to monitor the appliance for emergency situations.

The '519 patent teaches a control system including a fuel rate control valve, a water flow switch to control the fuel rate valve, an inlet water temperature switch to reduce fuel flow when the inlet temperature is high, a temperature switch at the water outlet to shut off fuel at a high temperature and a temperature sensor at the water outlet to regulate the fuel valve. The control system is geared solely to controlling the flow of fuel supplied to the burner.

The '446 patent teach a combination pressure and temperature limit control for an appliance which includes a draft inducer fan. The limit control device senses the presence of an obstruction in either the vent pipe or the vent hood inlet. When a reduction in air flow or undesirably high temperatures are sensed at the fan the limit control device shuts down the appliance. A draft inducer fan is required because the device works in conjunction with the fan.

Therefore, it is an object of this invention to provide a gas vent and burner monitoring system which monitors for emergency situations.

It is another object of the present invention to provide a gas vent and burner monitoring system which trips an alarm when an emergency situation is detected.

It is yet another object of the present invention to provide a gas vent and burner monitoring system which senses a clogged vent, improper vent installation or down draft.

Moreover, it is an object of the present invention to provide a gas vent and burner monitoring system which detects a malfunction of the burner system.

It is still another object of the present invention to provide a gas vent and burner monitoring system which detects an increase in pressure above normal operating levels.

DISCLOSURE OF THE INVENTION

Other objects and advantages will be accomplished by the present invention which serves to monitor a gas burner vent appliance. The gas vent and burner monitoring system of the present invention includes an alarm, a first sensor located proximate the burner and a second sensor located proximate the draft hood. Each of the first and second sensors are in electrical communication with the alarm and detects an occurrence of an event. When the event occurs, the respective sensor activates the alarm.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A gas vent and burner monitoring system incorporating various features of the present invention is illustrated generally at 10 in the figures. The gas vent and burner monitoring system 10 is designed to monitor and sense emergency situations in a gas burner vent appliance such as a water heater. Although the system 10 is demonstrated on a water heater, it is not intended to be limited to use on a water heater.

Figure 1:
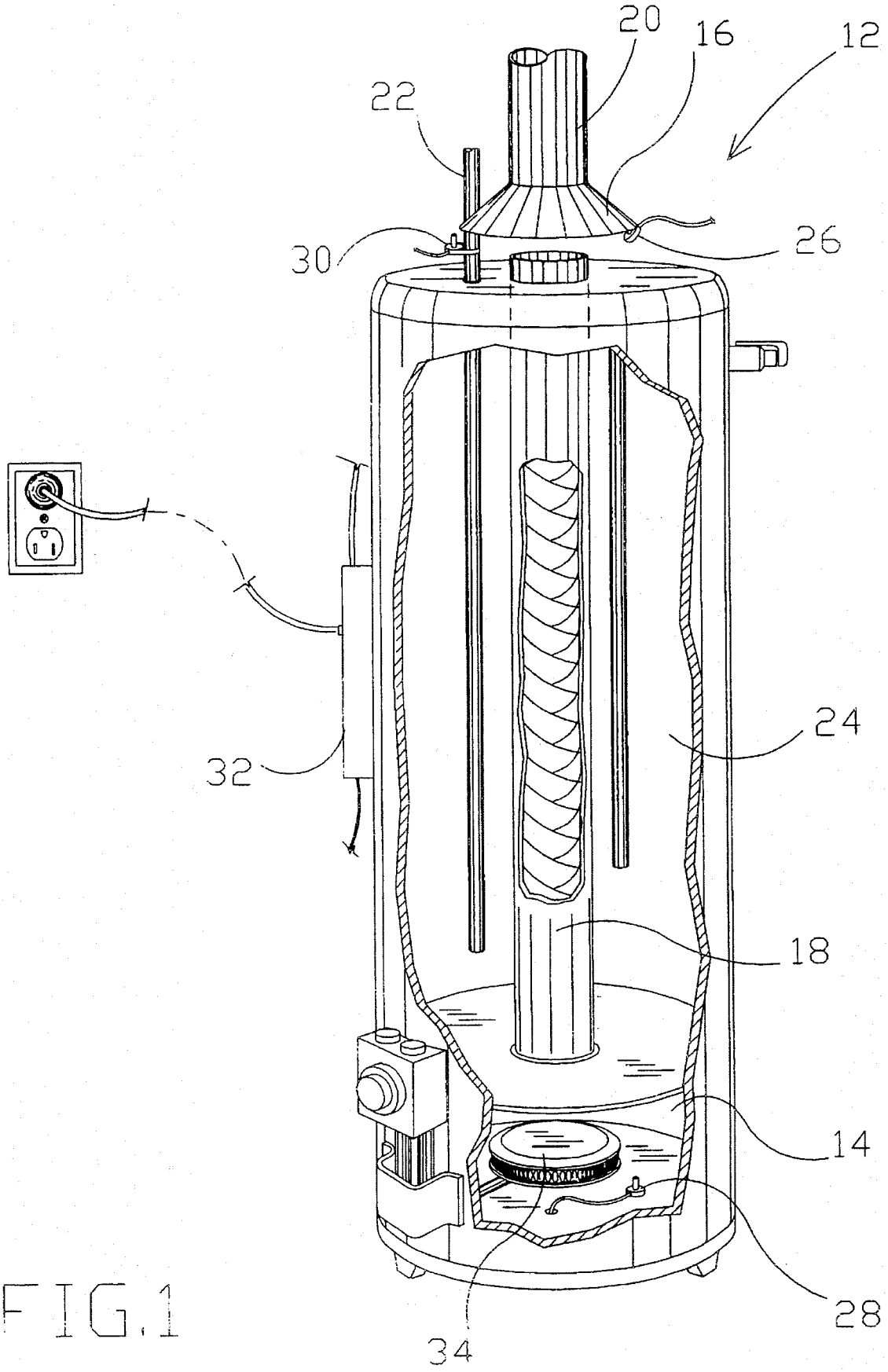
FIG. 1 is a perspective view of the gas vent and burner monitoring system constructed in accordance with several features of the present invention employed on a water heater; and, FIG. 2 is a schematic of the gas vent and burner monitoring system of the present invention.

A natural draft gas burner vent appliance such as a water heater 12 generally includes a combustion chamber 14, a draft hood 16 including an outlet pipe 20, a flue 18 extending between the combustion chamber 14 and the draft hood 16 and a pressurized chamber 24, as shown in FIG. 1. The combustion chamber 14 includes a burner 34 for combusting a fuel within the chamber 14. The flue 18 communicates with the combustion chamber 14 and provides an outlet for the exhaust of the resulting combustion gases and excess heat of combustion.

The gas vent and burner monitoring system 10 of present invention generally includes a sensor 28 located proximate the burner 34 and a sensor 26 located proximate the draft hood 16. Each sensor 26, 28 is in electrical communication with an alarm 32. Each of the sensors 26, 28 detects the occurrence an event and the respective sensor 26, 28 activates the alarm 32 when that event occurs.

In a first embodiment, the sensors 26, 28 are temperature sensors. When temperatures above a predetermined value are detected the respective sensor 26, 28 activates the alarm 32.

The draft hood sensor 26 senses the temperature at the draft hood 16 and is activated when the sensor 26 detects a temperature above a predetermined temperature and subsequently trips or sounds the alarm 32. A clogged vent, improper vent installation or down draft are examples of emergency situations where the temperature, as well as the level of carbon monoxide, rises to a dangerous level.

The burner sensor 28 is located proximate the burner 34 and detects any increase in temperature above a certain limit. The alarm 32 is tripped when the temperature at the burner 34 rises above this limit. In the operation of a natural draft water heater 12, the temperature limit is approximately 170° F. A malfunction in the burner 34, a collapsed flue 18 from excess pressure or deterioration of the flue 18 are examples of emergency situations where the burner sensor 28 would activate the alarm 32. Further, the burner sensor 28 senses any heat from any materials spilled and ignited at the base of the water heater 12.

In an alternate embodiment, the temperature sensors are replaced with oxygen depletion sensors set to detect when the presence of oxygen is below a predetermined value. In emergency situations such as a collapsed flue, a clogged vent or a burner burning to much fuel would deplete the presence of oxygen at the burner 34 or the draft hood 16.

In an alternate embodiment, the system 10 further includes a pressure sensor 30 which trips the alarm 32 when an increase in pressure in the pressurized chamber 24 above normal operating levels is detected. In the preferred embodiment, the pressure sensor 30 is located at the cold water inlet 22. The pressure sensor 30 is located at the supply line such that the pressure of the supply, as well as the pressure within the tank, can be monitored.

Figure 2:
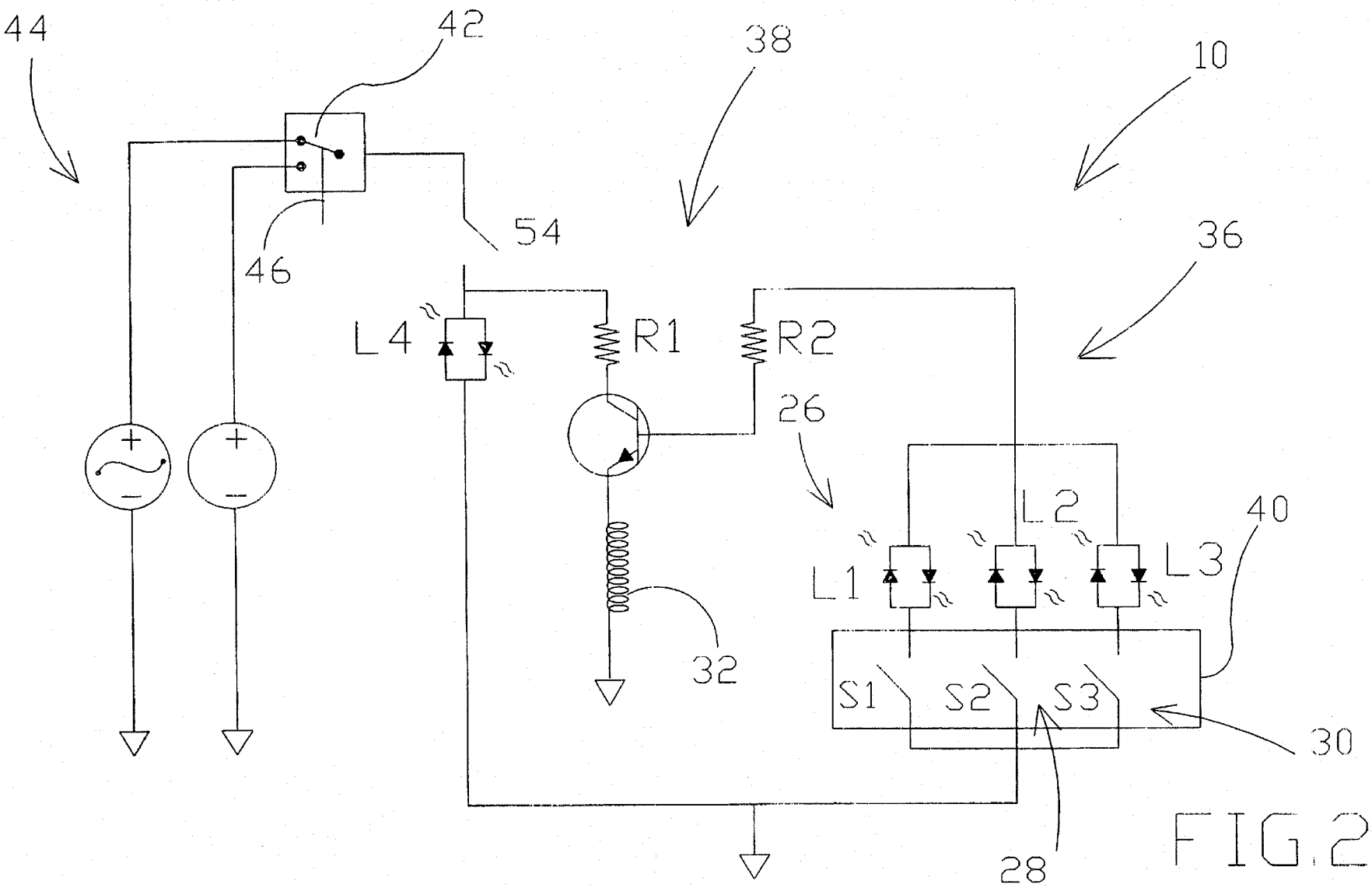

A schematic of the system 10 is shown in FIG. 2. In the preferred embodiment, the system 10 is capable of being powered by AC or DC current and includes an AC/DC adaptor 44 which includes an internal battery such that if the AC current is cut off, such as in a power outage, the monitoring circuitry 36 is powered by the internal battery. In the preferred embodiment, the AC/DC switch 42 is equipped with a plunger switch 46 such that the circuit is inclined to be powered by AC current. In the event of the removal of AC current, the switch 42 will permit the circuit 36 to be powered by the internal battery.

The monitoring circuitry 36 is turned on with the power on/off switch S4 and the power light emitting diode L4 will light up indicating that the monitoring circuitry 36 is monitoring the water heater 12.

The draft hood sensor 26, the burner sensor 28 and the pressure sensor 30 defines a respective switch S1, S2, S3 and a respective light emitting diode, L1, L2 and L3. The switches S1, S2, S3 are open when normal conditions exist. When an undesirable event occurs the appropriate sensor causes its respective switch S1, S2, S3 to close which in turn creates a voltage drop across the transistor circuitry 38 and thereby activates the alarm 32. Current will flow through the respective LED L1, L2, L3 to indicate which sensor switch has been closed. The sensors 26, 28, 30 are connected in a parallel manner such that when any one of the switches is closed the circuit is closed.

In an alternate embodiment, a manual reset control 40 is included to continue to power the LED(s) and alarm after the conditions which activated the LED(s) and alarm no longer exist. In this manner, the alarm continues to sound and the respective LEDs remain lit to indicate that a problem did exist and where that problem existed such that the owner is aware of the problem.

It will be noted that in an alternate embodiment (not shown) several sensors are associated with one switch, such that if a specific event detectable by one sensor occurs that sensor will trip the switch and subsequently activate the alarm.

It is envisioned that the gas vent and burner monitoring system of the present invention can be interfaced to a central alarm system or a controller system which shuts down the gas vent burner appliance.

From the foregoing description, it will be recognized by those skilled in the art that a gas vent and burner monitoring system offering advantages over the prior art has been provided. Specifically, the monitoring system monitors for malfunctions of the burner, the flue, the draft hood and the vent, as well as the pressurized interior chamber.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention.

I claim:

1. A gas vent and burner monitoring system for monitoring a gas burner vent appliance which includes a combustion chamber including a burner, a draft hood with an outlet pipe, a flue extending between the combustion chamber and the draft hood and an interior pressurized chamber, said gas vent and burner monitoring system comprising:

an alarm;

a first sensor located proximate the burner and in electrical communication with said alarm, said first sensor for detecting the occurrence of an event proximate the burner, said first sensor activating said alarm when said event occurs proximate the burner;

a second sensor located proximate the draft hood and in electrical communication with said alarm, said second sensor for detecting the occurrence of an event proximate the draft hood, said second sensor activating said alarm when said event occurs proximate the draft hood; and, a pressure sensor located proximate an inlet to the pressurized chamber and in electrical communication with said alarm, said pressure sensor for detecting an increase in pressure above a predetermined value, said pressure sensor activating said alarm when the pressure exceeds said predetermined value.

2. The gas vent and burner monitoring system of claim 1 wherein said event occurring proximate the burner is an increase in temperature above a predetermined value.

3. The gas vent and burner monitoring system of claim 1 wherein said event occurring proximate the burner is a decrease in oxygen below a predetermined value.

4. The gas vent and burner monitoring system of claim 1 wherein said event occurring proximate the draft hood is an increase in temperature above a predetermined value.

5. The gas vent and burner monitoring system of claim 1 wherein said event occurring proximate the draft hood is a decrease in oxygen below a predetermined value.

6. The gas vent and burner monitoring system of claim 1 wherein said first sensor is in electrical communication with a first light emitting diode, said second sensor being in electrical communication with a second light emitting diode, said first light emitting diode being lit when said event occurs proximate the burner, said second light emitting diode being lit when said event occurs proximate the draft hood.

7. The gas vent and burner monitoring system of claim 6 further including a manual reset control for supplying power to said alarm and said first light emitting diode after said event occurs proximate the burner and for supplying power to said alarm and said second light emitting diode after said event occurs proximate the draft hood.

8. A gas vent and burner monitoring system for monitoring a gas burner vent appliance which includes a combustion chamber including a burner, a draft hood with an outlet pipe, a flue extending between the combustion chamber and the draft hood and an interior pressurized chamber, said gas vent and burner monitoring system comprising:

an alarm;

a first sensor located proximate the burner and in electrical communication with said alarm, said first sensor for detecting the occurrence of an event proximate the burner, said first sensor activating said alarm when said event occurs proximate the burner, said event being selected from a group consisting of an increase in temperature above a predetermined value and a decrease in oxygen below a predetermined value;

a second sensor located proximater the draft hood and in electrical communication with said alarm, said second sensor for detecting the occurrence of an event proximate the draft hood, said second sensor activating said alarm when said event occurs proximate the draft hood, said event being selected from a group consisting of an increase in temperature above a predetermined value and a decrease in oxygen below a predetermined value; and a pressure sensor proximate an inlet to the pressurized chamber and in electrical communication with said alarm, said pressure sensor for detecting an increase in pressure above a predetermined value, said pressure sensor activating said alarm when the pressure exceeds said predetermined value.

9. A gas vent and burner monitoring system for monitoring a gas burner vent appliance which includes a combustion chamber including a burner, a draft hood with and outlet pipe, a flue extending between the combustion chamber and the draft hood and an interior pressurized chamber, said gas vent and burner monitoring system comprising:

an alarm;

a first sensor located proximate the burner and in electrical communication with said alarm, said first sensor for detecting the occurrence of an event proximate the burner, said first sensor activating said alarm when said event occurs proximate the burner, said first sensor being in electrical communication with a first light emitting diode, said first light emitting diode being lit when said event occurs proximate the burner;

a second sensor located proximate the draft hood and in electrical communication with said alarm, said second sensor for detecting the occurrence of an event proximate the draft hood, said second sensor activating said alarm when said event occurs proximate the draft hood, said second sensor being in electrical communication with a second light emitting diode, said second light emitting diode being lit when said event occurs proximate the draft hood; and, a manual reset control for supplying power to said alarm and said first light emitting diode after said event occurs proximate the burner and for supplying power to said alarm and said second light emitting diode after said event occurs proximate the draft hood.

10. The gas vent and burner monitoring system of claim 9 wherein said event occurring proximate the burner is an increase in temperature above a predetermined value.

11. The gas vent and burner monitoring system of claim 9 wherein said event occurring proximate the burner is a decrease in oxygen below a predetermined value.

12. The gas vent and burner monitoring system of claim 9 wherein said event occurring proximate the draft hood is an increase in temperature above a predetermined value.

13. The gas vent and burner monitoring system of claim 9 wherein said event occurring proximate the draft hood is a decrease in oxygen below a predetermined value.

14. The gas vent and burner monitoring system of claim 9 further includes an AC/DC adaptor, an internal battery and an AC/DC switch for switching from AC power to said internal battery when AC power is interrupted such that said system is continuously powerable.

* * * * *